US010453377B2

(12) United States Patent
Miao et al.

(10) Patent No.: US 10,453,377 B2
(45) Date of Patent: Oct. 22, 2019

(54) DISPLAY PANEL AND DRIVING METHOD THEREOF, AND DISPLAY APPARATUS

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Jinghua Miao, Beijing (CN); Chungchun Chen, Beijing (CN); Xue Dong, Beijing (CN); Xiaochuan Chen, Beijing (CN); Rui Xu, Beijing (CN); Mubing Li, Beijing (CN); Ming Yang, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 332 days.

(21) Appl. No.: 15/528,565

(22) PCT Filed: Oct. 10, 2016

(86) PCT No.: PCT/CN2016/101615
§ 371 (c)(1),
(2) Date: May 22, 2017

(87) PCT Pub. No.: WO2017/071459
PCT Pub. Date: May 4, 2017

(65) Prior Publication Data

US 2017/0269416 A1 Sep. 21, 2017

(30) Foreign Application Priority Data

Oct. 28, 2015 (CN) ..... 2015 1 0711721

(51) Int. Cl.
*G09G 3/20* (2006.01)
*G09G 3/36* (2006.01)

(52) U.S. Cl.
CPC ..... *G09G 3/2085* (2013.01); *G09G 3/2003* (2013.01); *G09G 3/36* (2013.01);
(Continued)

(58) Field of Classification Search
CPC ... G09G 2310/0278; G09G 2310/0297; G09G 3/2085
See application file for complete search history.

(56) References Cited

U.S. PATENT DOCUMENTS 8,643,632 B2 * 2/2014 Han ..... G02F 1/136286 345/204
9,312,284 B2 * 4/2016 Wu ..... G09G 3/344
(Continued)

FOREIGN PATENT DOCUMENTS

CN 201204027 A 3/2009
CN 102436796 A 5/2012
(Continued)

OTHER PUBLICATIONS

First Office Action from Chinese Patent Application No. 201510711721.8 dated Mar. 24, 2017.
(Continued)

*Primary Examiner* — Patrick F Marinelli
(74) *Attorney, Agent, or Firm* — Calfee, Halter & Griswold LLP

(57) ABSTRACT

A display panel is provided which includes a plurality of gate lines extending in a first direction, a plurality of data lines extending in a second direction substantially perpendicular to the first direction, and a driving circuit. The driving circuit is arranged at an end of the data lines for
(Continued)

supplying a scan signal to the gate lines and supplying grayscale signals to the data lines.

19 Claims, 5 Drawing Sheets

(52) U.S. Cl.
CPC ..... *G09G 2310/0278* (2013.01); *G09G 2310/0297* (2013.01)

(56) References Cited

U.S. PATENT DOCUMENTS 9,530,365 B2 * 12/2016 Shi ..... G09G 3/3648
9,767,725 B2 * 9/2017 Yang ..... G02F 1/1362
10,026,347 B2 * 7/2018 Xu ..... G09G 3/20
10,026,352 B2 * 7/2018 Miao ..... G09G 3/2092
10,255,840 B2 * 4/2019 Yang ..... G02F 1/1362
2010/0127258 A1 * 5/2010 Kang ..... G02F 1/13458 257/48
2010/0238148 A1 * 9/2010 Sah ..... G09G 3/36 345/206
2011/0279418 A1 * 11/2011 Han ..... G02F 1/136286 345/204
2013/0257837 A1 * 10/2013 Wang ..... G09G 3/3696 345/211
2013/0271357 A1 * 10/2013 Wang ..... G09G 3/3677 345/92
2014/0146025 A1 * 5/2014 Shi ..... G09G 3/3648 345/204
2015/0091883 A1 4/2015 Pyun et al.
2015/0129880 A1 * 5/2015 Wu ..... G09G 3/344 257/72
2016/0091969 A1 * 3/2016 Liu ..... G06F 1/1637 345/156
2017/0003541 A1 * 1/2017 Xu ..... G02F 1/13454
2017/0061853 A1 * 3/2017 Yang ..... G02F 1/1362
2017/0069280 A1 * 3/2017 Xu ..... G09G 3/20
2017/0269416 A1 * 9/2017 Miao ..... G09G 3/36
2018/0315367 A1 * 11/2018 Yang ..... G02F 1/1362
2019/0057658 A1 * 2/2019 Nie ..... G09G 3/3266

FOREIGN PATENT DOCUMENTS

CN 102456316 A 5/2012
CN 102723064 A 10/2012
CN 104112432 A 10/2014
CN 104360558 A 2/2015
CN 104424907 A 3/2015
CN 104751766 A 7/2015
CN 105206242 A 12/2015
KR 20130069087 A 6/2013

OTHER PUBLICATIONS

Search Report from International Application No. PCT/CN2016/101615 dated Dec. 28, 2016.

* cited by examiner

| + | - | + | - | + | - | + | - | + | - | + | - | ..... | + | - | + | - | + | - | + | - | + | - | + | - |
|---|---|---|---|---|---|---|---|---|---|---|---|---|---|---|---|---|---|---|---|---|---|---|---|---|
| 255 | R | G | 255 | 0 | B | R | 0 | 0 | G | B | 0 | ..... | 0 | R | G | 0 | 0 | B | R | 0 | 0 | G | B | 0 |
| 0 | R | G | 0 | 255 | B | R | 255 | 0 | G | B | 0 | ..... | 0 | R | G | 0 | 0 | B | R | 0 | 0 | G | B | 0 |
| 0 | R | G | 0 | 0 | B | R | 0 | 255 | G | B | 255 | ..... | 0 | R | G | 0 | 0 | B | R | 0 | 0 | G | B | 0 |
| ... | ... | ... | ... | ... | ... | ... | ... | ... | ... | ... | ... | ..... | ... | ... | ... | ... | ... | ... | ... | ... | ... | ... | ... | ... |
| 0 | R | G | 0 | 0 | B | R | 0 | 0 | G | B | 0 | ..... | 0 | R | G | 0 | 0 | B | R | 0 | 255 | G | B | 255 |

FIG. 7

| - | + | - | + | - | + | - | + | - | + | - | | ..... | - | + | - | + | - | + | - | + | - | + | - | + |
|---|---|---|---|---|---|---|---|---|---|---|---|---|---|---|---|---|---|---|---|---|---|---|---|---|
| 255 | R | G | 255 | 0 | B | R | 0 | 0 | G | B | 0 | ..... | 0 | R | G | 0 | 0 | B | R | 0 | 0 | G | B | 0 |
| 0 | R | G | 0 | 255 | B | R | 255 | 0 | G | B | 0 | ..... | 0 | R | G | 0 | 0 | B | R | 0 | 0 | G | B | 0 |
| 0 | R | G | 0 | 0 | B | R | 0 | 255 | G | B | 255 | ..... | 0 | R | G | 0 | 0 | B | R | 0 | 0 | G | B | 0 |
| ... | ... | ... | ... | ... | ... | ... | ... | ... | ... | ... | ... | ..... | ... | ... | ... | ... | ... | ... | ... | ... | ... | ... | ... | ... |
| 0 | R | G | 0 | 0 | B | R | 0 | 0 | G | B | 0 | ..... | 0 | R | G | 0 | 0 | B | R | 0 | 255 | G | B | 255 |

FIG. 8

DISPLAY PANEL AND DRIVING METHOD THEREOF, AND DISPLAY APPARATUS

CROSS-REFERENCE TO RELATED APPLICATIONS

The present application is the U.S. national phase entry of PCT/CN2016/101615, with an international filing date of Oct. 10, 2016, which claims the benefit of Chinese Patent Application No. 201510711721.8, filed on Oct. 28, 2015, the entire disclosures of which are incorporated herein by reference.

TECHNICAL FIELD

The present disclosure relates to the field of display technologies, and particularly to a display panel and a driving method thereof, as well as a display apparatus including the display panel.

BACKGROUND

In an existing display screen, the gate driver unit is generally fabricated at the left and right sides of the screen, rendering it difficult to achieve a narrow bezel design. This affects the user's viewing experience.

With a narrow bezel or bezel-less design, the user's viewing experience would have been significantly improved. Thus, it would be desirable to provide a mechanism that enables a narrow bezel or bezel-less display screen.

SUMMARY

Embodiments of the present disclosure provide a display panel and a driving method thereof, as well as a display apparatus, which seek to achieve a narrow bezel or bezel-less design.

According to an exemplary embodiment of the present disclosure, a display panel is provided having a plurality of gate lines extending in a first direction; a plurality of data lines extending in a second direction substantially perpendicular to the first direction; and a driving circuit arranged at an end of the data lines and comprising: a plurality of scan signal output terminals each connected to a respective one of the gate lines; a plurality of grayscale signal output terminals each connected to a respective one of the data lines; a gate driver unit configured to supply a scan signal sequentially to the plurality of gate lines via the plurality of scan signal output terminals; and a source driver unit configured to supply respective grayscale signals to the plurality of data lines via the plurality of grayscale signal output terminals.

According to an exemplary embodiment of the present disclosure, a display panel is provided having a plurality of pixel units arranged in an array, each of the pixel units having a respective pixel thin-film transistor; a plurality of gate lines extending in a first direction, each of the gate lines connected to a respective row of pixel units in the array; a plurality of data lines extending in a second direction substantially perpendicular to the first direction, each of the data lines connected to a respective column of pixel units in the array; a driving circuit arranged at an end of the data lines and having a plurality of common terminals for outputting a scan signal and respective grayscale signals; a switch network operable to selectively couple the common terminals to the gate lines or the data lines; and a driving unit configured to a) supply the scan signal sequentially to the plurality of common terminals in a plurality of first time periods that are temporally separate and cause, in each first time period in which the scan signal is supplied to one of the common terminals, the switch network to couple the plurality of common terminals to the plurality of gate lines respectively such that the scan signal is applied to one of the gate lines, and to b) supply, in each of second time periods immediately subsequent to respective first time periods, the grayscale signals to the plurality of common terminals and couple each of the common terminals to a respective one of the data lines such that the grayscale signals are transferred to the array of pixel units; and plurality of gate voltage storage capacitors each connected between a respective one of the gate lines and a predetermined voltage and operable to enable, after being charged by the scan signal applied to the respective gate line, the pixel thin-film transistors of a row of pixel units connected to the gate line to remain turned-on in the second time period in which the grayscale signals for the row of pixel units are supplied.

In certain exemplary embodiments, the driving unit is further configured to supply a reversal signal sequentially to the plurality of common terminals in a plurality of third time periods immediately subsequent to respective second time periods and cause, in each third time period in which the reversal signal is supplied to one of the common terminals, the switch network to couple the plurality of common terminals to the plurality of gate lines respectively to discharge the charged gate voltage storage capacitor, the reversal signal having an opposite polarity to that of the scan signal.

In certain exemplary embodiments, the switch network has a plurality of first switches operable to couple the plurality of common terminals to the plurality of gate lines respectively in response to a first gate control signal supplied by the driving unit, the first gate control signal being synchronous with one of the scan signal and the reversal signal; and a plurality of second switches operable to couple the plurality of common terminals to the plurality of gate lines respectively in response to a second gate control signal supplied by the driving unit, the second gate control signal being synchronous with the other one of the scan signal and the reversal signal.

In certain exemplary embodiments, the first switch and the second switch that are connected to the same gate line share the same common terminal.

In certain exemplary embodiments, each of the first switches comprises a transistor having a gate for receiving the first gate control signal, a first electrode connected to a respective one of the common terminals, and a second electrode connected to a respective one of the gate lines.

In certain exemplary embodiments, each of the second switches comprises a transistor having a gate for receiving the second gate control signal, a first electrode connected to a respective one of the common terminals, and a second electrode connected to a respective one of the gate lines.

In certain exemplary embodiments, the driving unit is further configured to, in each of the second time periods supply, in a first time interval, grayscale signals for odd pixel units in a respective row of pixel units to the plurality of common terminals and cause the switch network to couple the plurality of common terminals to odd ones of the data lines respectively; and supply, in a second time interval, grayscale signals for even pixel units in the respective row of pixel units to the plurality of common terminals and cause the switch network to couple the plurality of common terminals to even ones of the data lines respectively.

In certain exemplary embodiments, the switch network further includes a plurality of third switches operable to couple the plurality of common terminals to the odd ones of the data lines in the first time interval in response to a first data control signal supplied by the driving unit; and a plurality of fourth switches operable to couple the plurality of common terminals to the even ones of the data lines in the second time interval in response to a second data control signal supplied by the driving unit.

In certain exemplary embodiments, the driving unit is further configured such that the first data control signal and the second data control signal are successively supplied.

In certain exemplary embodiments, each of the third switches is paired to a respective one of the fourth switches. In each pair the third switch and the fourth switch share the same common terminal. The odd data line connected to the third switch is adjacent to the even data line connected to the fourth switch.

In certain exemplary embodiments, each of the third switches comprises a transistor having a gate for receiving the first data control signal, a first electrode connected to a respective one of the common terminals, and a second electrode connected to a respective one of the odd data lines.

In certain exemplary embodiments, each of the fourth switches comprises a transistor having a gate for receiving the second data control signal, a first electrode connected to a respective one of the common terminals, and a second electrode connected to a respective one of the even data lines.

According to certain exemplary embodiments of the present disclosure, a display apparatus is provided having a timing controller configured to generate output image data based on input image data; and the display panel as described in certain exemplary embodiments, the display panel configured to display an image based on the output image data.

In certain exemplary embodiments, the driving unit is further configured to supply a reversal signal sequentially to the plurality of common terminals in a plurality of third time periods immediately subsequent to respective second time periods and cause, in each third time period in which the reversal signal is supplied to one of the common terminals, the switch network to couple the plurality of common terminals to the plurality of gate lines respectively to discharge the charged gate voltage storage capacitor, the reversal signal having an opposite polarity to that of the scan signal. The timing controller is further configured to generate a first data corresponding to the scan signal and a second data corresponding to the reversal signal. The driving unit is further configured to generate the scan signal, the reversal signal and the grayscale signals based on the first data, the second data and the output image data respectively.

According to certain exemplary embodiments of the present disclosure, a method of driving the display panel as described in certain exemplary embodiments is provided comprising, for each row of pixel units in the array: supplying the scan signal to the gate line connected to the row of pixel units in a first time period; and supplying respective grayscale signals to the plurality of data lines in a second time period immediately subsequent to the first time period.

In certain exemplary embodiments, supplying the scan signal to the gate line connected to the row of pixel units comprises charging the gate voltage storage capacitor connected to the gate line with the scan signal, the charged gate voltage storage capacitor enabling the pixel thin-film transistors of the row of pixel units to remain turned-on during the second time period.

In certain exemplary embodiments, supplying respective grayscale signals to the plurality of data lines includes supplying grayscale signals for odd pixel units in the row of pixel units to odd ones of the data lines in a first time interval; and supplying grayscale signals for even pixel units in the row of pixel units to even ones of the data lines in a second time interval.

In certain exemplary embodiments, the method further comprises supplying a reversal signal sequentially to the gate line connected to the row of pixel units in a third time period immediately subsequent to the second time period, the reversal signal having an opposite polarity to that of the scan signal.

In certain exemplary embodiments, the method further comprises generating, prior to supplying the scan signal, a first data corresponding to the scan signal and a second data corresponding to the reversal signal to enable the driving unit to generate the scan signal and the reversal signal based on the first data and the second data respectively.

As compared with prior art where the gate driver unit is arranged at the left and right sides of the display panel, the gate driver unit in embodiments of the present disclosure is arranged at an end of the data lines of the display panel, for example, at a bottom end of the display panel, thus enabling a narrow bezel or bezel-less design of the display panel.

BRIEF DESCRIPTION OF THE DRAWINGS

The accompanying drawings are provided for a further understanding of the present disclosure, which form a part of the description and together with the following detailed description are intended for explanation and not restriction of the present disclosure.

FIG. 7 is a digital data table for generation of the scan signal, the reversal signal and the grayscale signals as shown in FIG. 4; and FIG. 8 is a digital data table for generation of the scan signal, the reversal signal and the grayscale signals as shown in FIG. 5.

DETAILED DESCRIPTION

Embodiments of the present disclosure will be illustrated below in detail with reference to the accompanying drawings. It is to be understood that the embodiments described herein are intended to be only illustrative and explanatory, and not restrictive.

Figure 1:
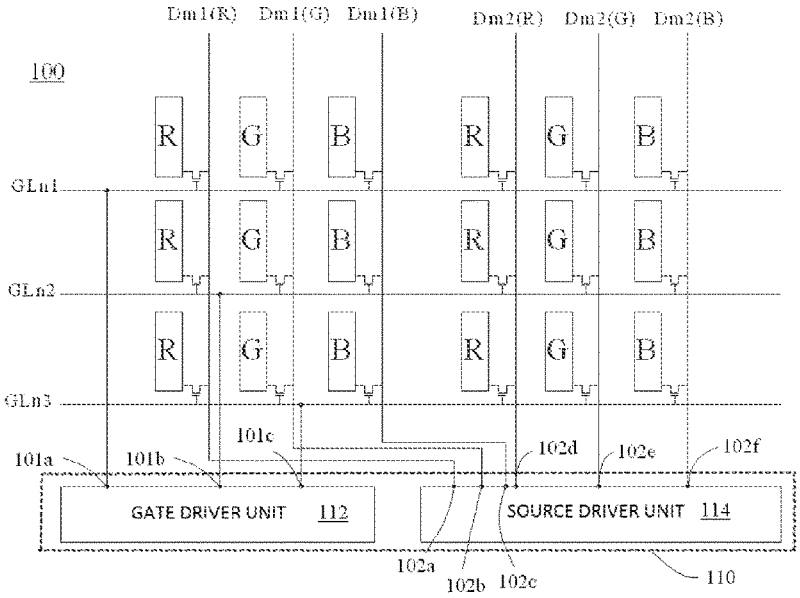
FIG. 1 is a schematic diagram of a display panel according to an embodiment of the present disclosure.

FIG. 1 is a schematic diagram of a display panel 100 according to an embodiment of the present disclosure.

Referring to FIG. 1, the display panel 100 includes a plurality of gate lines GLn1, GLn2, GLn3, a plurality of data lines Dm1(R), Dm1(G), Dm1(B), Dm2(R), Dm2(G), Dm2(B), and a driving circuit 110.

The gate lines GLn1, GLn2, GLn3 extend in a first direction (the horizontal direction in FIG. 1), and the data lines Dm1(R), Dm1(G), Dm1(B), Dm2(R), Dm2(G), Dm2(B) extend in a second direction (the vertical direction in FIG. 1) that is substantially perpendicular to the first direction. Thereby, a plurality of pixel units R, B are defined.

The driving circuit 110 is arranged at an end of the data lines Dm1(R), Dm1(G), Dm1(B), Dm2(R), Dm2(G), Dm2(B) (at the bottom end of the display panel 100 in FIG. 1), and includes a plurality of scan signal output terminals 101*a*, 101*b*, 101*c*, a plurality of grayscale signal output terminals 102*a*, 102*b*, 102*c*, 102*d*, 102*e*, 102*f*, a gate driver unit 112 and a source driver unit 114.

Each of the plurality of scan signal output terminals 101*a*, 101*b*, 101*c* is connected to a respective one of the gate lines GLn1, GLn2, GLn3, and each of the plurality of grayscale signal output terminals 102*a*, 102*b*, 102*c*, 102*d*, 102*e*, 102*f* is connected to a respective one of the data lines Dm1(R), Dm1(G), Dm1(B), Dm2(R), Dm2(G), Dm2(B).

The gate driver unit 112 is configured to supply a scan signal sequentially to the plurality of gate lines GLn1, GLn2, GLn3 via the plurality of scan signal output terminals 101*a*, 101*b*, 101*c*. The source driver unit 114 is configured to supply respective grayscale signals to the plurality of data lines via the plurality of grayscale signal output terminals 102*a*, 102*b*, 102*c*, 102*d*, 102*e*, 102*f*.

Traditionally, the gate driver unit is fabricated at the left and right sides of the display panel, forming a gate driver on array (GOA) circuit for example. In contrast, according to the embodiment of the present disclosure, the gate driver unit 112 is disposed at an end of the data lines Dm1(R), Dm1(G), Dm1(B), Dm2(R), Dm2(G), Dm2(B), for example, at the bottom end of the display panel 100. This may lead to a reduction in the size of the bezel of the display panel 100, thus achieving a narrow bezel or bezel-less design.

The inventors further recognize that the gate driving functionality provided by the gate driver unit 112 and the source driving functionality provided by the source driver unit 114 may be implemented by a single integrated circuit, thus further reducing the footprint of the driving circuit 110.

Figure 2:
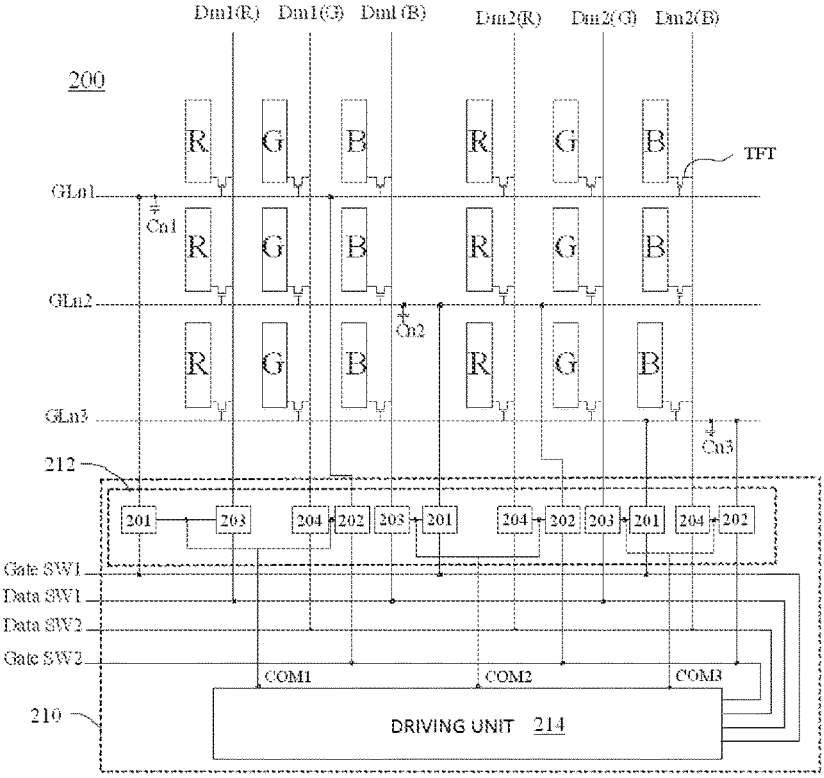
FIG. 2 is a schematic diagram of a display panel according to another embodiment of the present disclosure.

FIG. 2 is a schematic diagram of a display panel 200 according to another embodiment of the present disclosure.

Referring to FIG. 2, the display panel 200 includes a plurality of pixel units denoted by R, B, a plurality of gate lines GLn1, GLn2, GLn3, a plurality of data lines Dm1(R), Dm1(G), Dm1(B), Dm2(R), Dm2(G), Dm2(B), a driving circuit 210 and a plurality of gate voltage storage capacitors Cn1, Cn2, Cn3.

The pixel units R, B are arranged in an array, and each of the pixel units has a respective pixel thin-film transistor (TFT). Each of the gate lines GLn1, GLn2, GLn3 is connected to a respective row of pixel units in the array, and each of the data lines Dm1(R), Dm1(G), Dm1(B), Dm2(R), Dm2(G), Dm2(B) is connected to a respective column of pixel units in the array.

The driving circuit 210 is arranged at an end of the data lines Dm1(R), Dm1(G), Dm1(B), Dm2(R), Dm2(G), Dm2(B) (at the bottom end of the display panel 200 in FIG. 2), and includes a plurality of common terminals COM1, COM2, COM3, a switch network 212 and a driving unit 214.

The plurality of common terminals COM1, COM2, COM3 are used to output a scan signal and respective grayscale signals, all of which are generated by the driving unit 214. The scan signal (a gate-on voltage) is used to turn on the pixel thin-film transistors of a row of pixel units. The grayscale signals (grayscale voltages) are used to cause the pixel units to render corresponding grayscales, thus displaying an image on the display panel.

The switch network 212 is operable to selectively couple the common terminals COM1, COM2, COM3 to the gate lines GLn1, GLn2, GLn3 or the data lines Dm1(R), Dm1(G), Dm1(B), Dm2(R), Dm2(G), Dm2(B). The switch network 212 includes a plurality of switches 201, 202, 203, 204.

A plurality of first switches 201 are operable to couple the plurality of common terminals COM1, COM2, COM3 to the plurality of gate lines GLn1, GLn2, GLn3 respectively in response to a first gate control signal "Gate SW1" supplied by the driving unit 214.

A plurality of second switches 202 are operable to couple the plurality of common terminals COM1, COM2, COM3 to the plurality of gate lines GLn1, GLn2, GLn3 respectively in response to a second gate control signal "Gate SW2" supplied by the driving unit 214.

A plurality of third switches 203 are operable to couple the plurality of common terminals COM1, COM2, COM3 to the odd ones of the data lines Dm1(R), Dm1(G), Dm1(B), Dm2(R), Dm2(G), Dm2(B) in a first time interval in response to a first data control signal "Data SW1" supplied by the driving unit 214.

A plurality of fourth switches 204 are operable to couple the plurality of common terminals COM1, COM2, COM3 to the even ones of the data lines Dm1(R), Dm1(G), Dm1(B), Dm2(R), Dm2(G), Dm2(B) in a second time interval in response to a second data control signal "Data SW2" supplied by the driving unit 214.

In the example of FIG. 2, the common terminal COM1 is coupled to the gate line GLn1, the data line Dm1(R) or the data line Dm1(G) via the switch network 212, the common terminal COM2 is coupled to the gate line GLn2, the data line Dm1(B) or the data line Dm2(R) via the switch network 212, and the common terminal COM3 is coupled to the gate line GLn3, the data line Dm2(G) or the data line Dm2(B) via the switch network 212.

Although each of the common terminals COM1, COM2, COM3 is shown as being coupled to two data lines via the switch network 212, other embodiments are possible. For example, each common terminal may be coupled to more or less data lines via the switch network 212.

The driving unit 214 is configured to supply the scan signal sequentially to the plurality of common terminals COM1, COM2, COM3 in a plurality of first time periods that are temporally separate and cause, in each first time period in which the scan signal is supplied to one of the common terminals COM1, COM2, COM3, the switch network 212 to couple the plurality of common terminals COM1, COM2, COM3 to the plurality of gate lines GLn1, GLn2, GLn3 respectively such that the scan signal is applied to one of the gate lines GLn1, GLn2, GLn3.

The driving unit 214 is further configured to supply, in each of second time periods immediately subsequent to respective first time periods, the grayscale signals to the plurality of common terminals COM1, COM2, COM3 and couple each of the common terminals COM1, COM2, COM3 to a respective one of the data lines Dm1(R), Dm1(G), Dm1(B), Dm2(R), Dm2(G), Dm2(B) such that the grayscale signals are transferred to the array of pixel units R, B.

For each row of pixel units, the scan signal and the grayscale signals are supplied in the first time period and the second time period, respectively. In this case, it is required that the pixel thin-film transistors (TFTs) of the row of pixel units remain turned-on during the second time period such that the grayscale signals can be written to the pixel units.

To do so, the display panel 200 further includes a plurality of gate voltage storage capacitors Cn1, Cn2, Cn3, each of which is connected between a respective one of the gate lines GLn1, GLn2, GLn3 and a predetermined voltage (e.g., a ground voltage). In the example of FIG. 2, the gate voltage storage capacitor Cn1 is connected to the gate line GLn1, the gate voltage storage capacitor Cn2 is connected to the gate line GLn2, and the gate voltage storage capacitor Cn3 is connected to the gate line GLn3.

The capacitance of the gate voltage storage capacitors Cn1, Cn2, Cn3 is selected such that after being fully charged Cn1, Cn2, Cn3 can maintain the gate-on voltage for a predetermined period of time. Specifically, each of the gate voltage storage capacitors Cn1, Cn2, Cn3 is operable to enable, after being charged by the scan signal applied to the respective gate line, the pixel thin-film transistors of a row of pixel units connected to the gate line to remain turned-on during the second time period in which the grayscale signals for the row of pixel units are supplied.

It will be appreciated that in FIGS. 1 and 2 these three gate lines GLn1, GLn2, GLn3 and six data lines Dm1(R), Dm1(G), Dm1(B), Dm2(R), Dm2(G), Dm2(B) are only exemplary, and should not be considered as limiting of the scope of the present disclosure.

Figure 3:
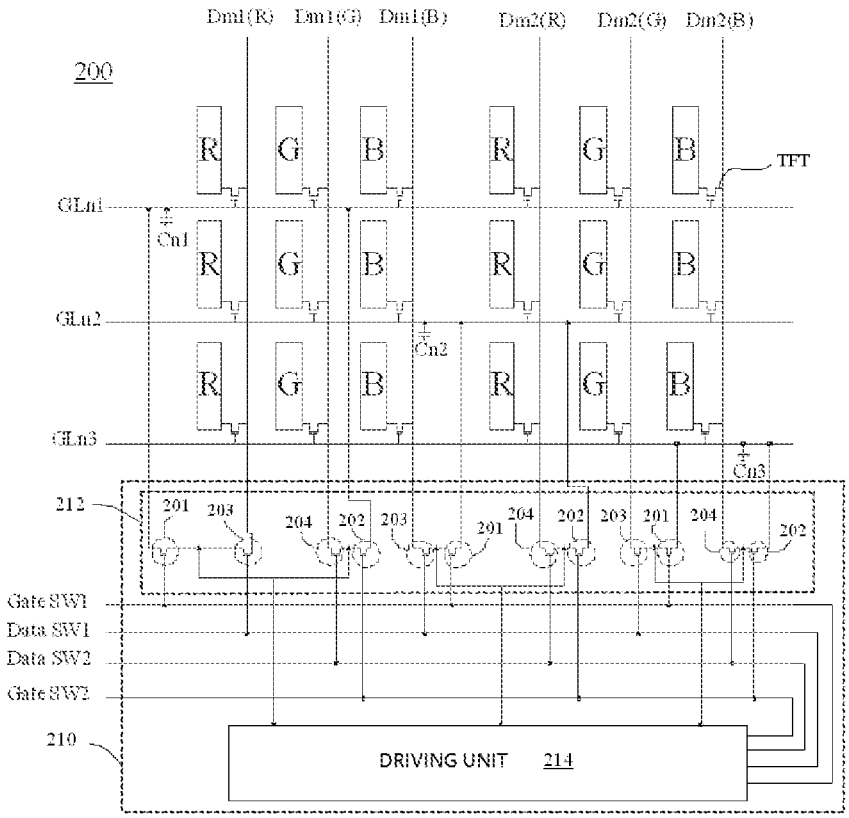
FIG. 3 is a schematic diagram of an example implementation of the display panel as shown in FIG. 2.

FIG. 3 is a schematic diagram of an example implementation of the display panel 200 as shown in FIG. 2.

Referring to FIG. 3, the switches 201, 202, 203, 204 in the switch network 212 are each implemented by a transistor.

Each of transistors 201 has a gate for receiving the first gate control signal "Gate SW1", a first electrode connected to a respective one of the common terminals COM1, COM2, COM3, and a second electrode connected to a respective one of the gate lines GLn1, GLn2, GLn3.

Each of transistors 202 has a gate for receiving the second gate control signal "Gate SW2", a first electrode connected to a respective one of the common terminals COM1, COM2, COM3, and a second electrode connected to a respective one of the gate lines GLn1, GLn2, GLn3.

Each of transistors 203 has a gate for receiving the first data control signal "Data SW1", a first electrode connected to a respective one of the common terminals COM1, COM2, COM3, and a second electrode connected to a respective one of the odd data lines.

Each of transistors 204 has a gate for receiving the second data control signal "Data SW2", a first electrode connected to a respective one of the common terminals COM1, COM2, COM3, and a second electrode connected to a respective one of the even data lines.

In the example of FIG. 3, the individual switches 201, 202, 203, 204 may be thin-film transistors or other suitable type of transistors. Although the switches 201, 202, 203, 204 are shown as N-type transistors, P-type transistors may be used in other embodiments. As is known, the gate voltage for turning on a P-type transistor is a low level voltage.

Operations of the display panel 200 are explained below with reference to FIGS. 4 and 5.

Figure 4:
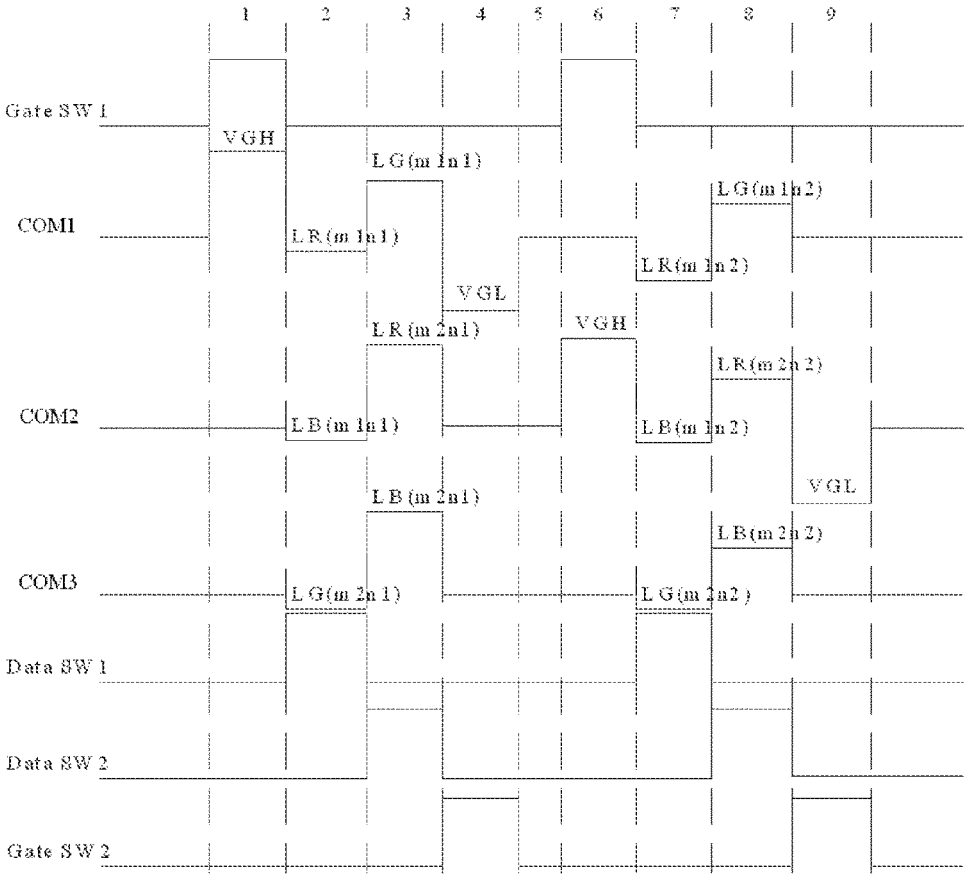
FIG. 4 is a timing diagram of the display panel as shown in FIG. 3 before polarity inversion.

FIG. 4 is a timing diagram of the display panel as shown in FIG. 3 before polarity inversion. In the example of FIG. 4, the polarity inversion takes a form of column inversion where the grayscale signals supplied to two adjacent columns of pixel units have opposite polarities. In other embodiments, other forms of polarity inversion are possible, such as dot inversion or frame inversion.

In phase 1 (the first time period), the first gate control signal "Gate SW1" causes the first switches 201 to turn on. The scan signal VGH output via the common terminal COM1 is transferred to the gate voltage storage capacitor Cn1. The gate voltage storage capacitor Cn1 is charged and the voltage on the gate line GLn1 rises. At the end of phase 1, the voltage on the gate line GLn1 reaches a peak. It is to be noted that the capacitance of the gate voltage storage capacitor Cn1 is selected such that the voltage on the gate line GLn1 enables the pixel thin-film transistors connected to the gate line GLn1 to remain turned-on in phases 2 and 3.

In phase 2 (the first time interval of the second time period), the first data control signal "Data SW1" causes the third switches 203 connected to the odd data lines (the data lines Dm1(R), Dm1(B) and Dm2(G) in FIG. 3) to turn on. Since the pixel thin-film transistors connected to the gate line GLn1 are turned on, the grayscale signals LR(m1n1), LB(m1n1) and LG(m2n1) from the driving unit 214 are written to the odd pixel units connected to the gate line GLn1, respectively.

In phase 3 (the second time interval of the second time period), the second data control signal "Data SW2" causes the fourth switches 204 connected to the even data lines (the data lines Dm1(G), Dm2(R) and Dm2(B) in FIG. 3) to turn on. Since the pixel thin-film transistors connected to the gate line GLn1 are turned on, the grayscale signals LG(m1n1), LR(m2n1) and LB(m2n1) from the driving unit 214 are written to the even pixel units connected to the gate line GLn1, respectively.

In phase 4 (the third time period), the second gate control signal "Gate SW2" causes the second switches 202 to turn on. The reversal signal VGL output via the common terminal COM1 is transferred to the gate voltage storage capacitor Cn1. The gate voltage storage capacitor Cn1 is reversely charged and the voltage on the gate line GLn1 falls. At the end of phase 4, the voltage on the gate line GLn1 falls down to a minimum. The pixel thin-film transistors of the n1-th row of pixel units are turned off. This can ensure a normal display of a next frame of image, avoiding effects such as artifacts.

In phase 5 (a reset phase), all the external signals (including the scan signal and the grayscale signals) are at a low level. It is to be noted that this phase may be omitted.

In phase 6 (the first time period), the first gate control signal "Gate SW1" causes the first switches 201 to turn on. The scan signal VGH output via the common terminal COM2 is transferred to the gate voltage storage capacitor Cn2. The gate voltage storage capacitor Cn2 is charged and the voltage on the gate line GLn2 rises. At the end of phase 6, the voltage on the gate line GLn2 reaches a peak. It is to be noted that the capacitance of the gate voltage storage capacitor Cn2 is selected such that the voltage on the gate line GLn2 enables the pixel thin-film transistors connected to the gate line GLn2 to remain turned-on in phases 7 and 8.

In phase 7 (the first time interval of the second time period), the first data control signal "Data SW1" causes the third switches 203 connected to the odd data lines (the data lines Dm1(R), Dm1(B) and Dm2(G) in FIG. 3) to turn on. Since the pixel thin-film transistors connected to the gate line GLn2 are turned on, the grayscale signals LR(m1n2), LB(m1n2) and LG(m2n2) from the driving unit 214 are written to the odd pixel units connected to the gate line GLn2, respectively.

In phase 8 (the second time interval of the second time period), the second data control signal "Data SW2" causes the fourth switches 204 connected to the even data lines (the data lines Dm1(G), Dm2(R) and Dm2(B) in FIG. 3) to turn on. Since the pixel thin-film transistors connected to the gate line GLn2 are turned on, the grayscale signals LG(m1n2), LR(m2n2) and LB(m2n2) from the driving unit 214 are written to the even pixel units connected to the gate line GLn2, respectively.

In phase 9 (the third time period), the second gate control signal "Gate SW2" causes the second switches 202 to turn on. The reversal signal VGL output via the common terminal COM2 is transferred to the gate voltage storage capacitor Cn2. The gate voltage storage capacitor Cn2 is reversely charged and the voltage on the gate line GLn2 falls. At the end of phase 9, the voltage on the gate line GLn2 falls down to a minimum. The pixel thin-film transistors of the n2-th row of pixel units are turned off.

Thereafter the above operations are repeated for the respective rows of pixel units and thus are not described here.

Figure 5:
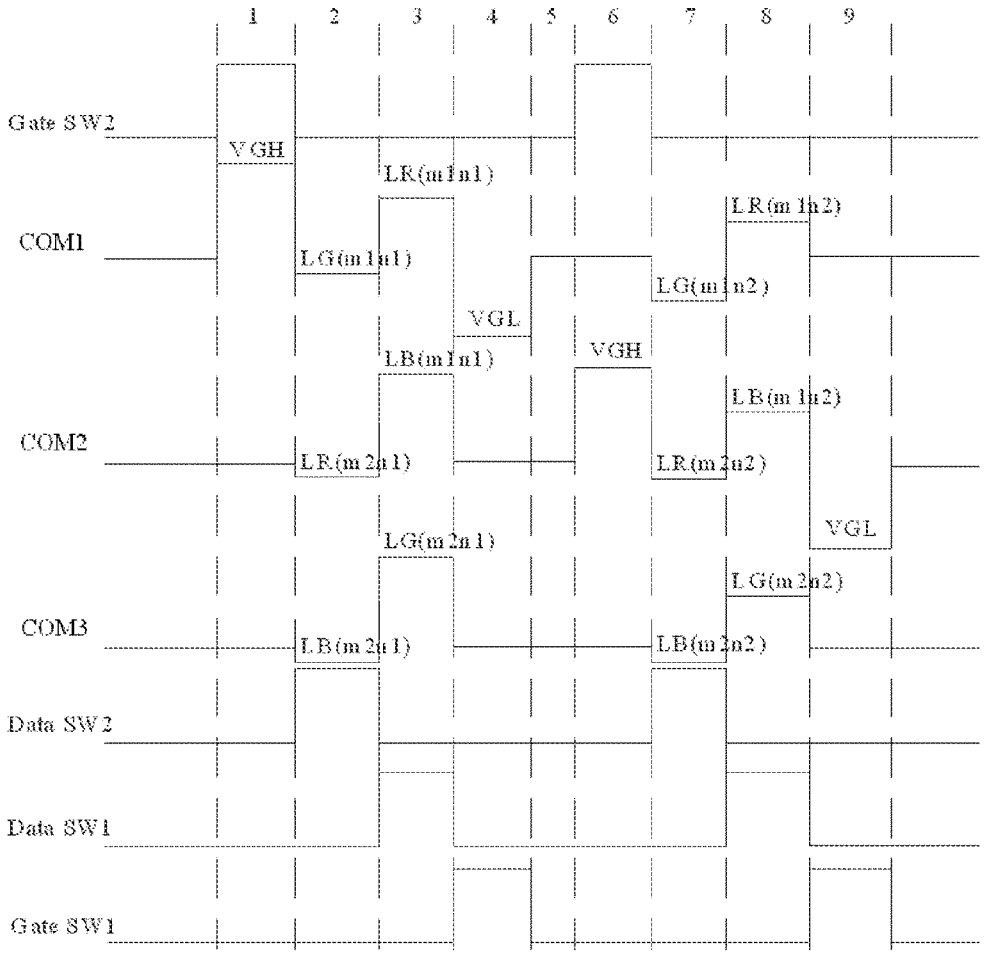
FIG. 5 is a timing diagram of the display panel as shown in FIG. 3 after polarity inversion.

FIG. 5 is a timing diagram of the display panel as shown in FIG. 3 after polarity inversion (column inversion), wherein the polarities of the grayscale signals supplied to the respective columns of pixel units are inversed with respect to those before the polarity inversion.

In phase 1 (the first time period), the second gate control signal "Gate SW2" causes the second switches 202 to turn on. The scan signal VGH output via the common terminal COM1 is transferred to the gate voltage storage capacitor Cn1. The gate voltage storage capacitor Cn1 is charged and the voltage on the gate line GLn1 rises. At the end of phase 1, the voltage on the gate line GLn1 reaches a peak.

In phase 2 (the first time interval of the second time period), the second data control signal "Data SW2" causes the fourth switches 204 connected to the even data lines (the data lines Dm1(G), Dm2(R) and Dm2(B) in FIG. 3) to turn on. Since the pixel thin-film transistors connected to the gate line GLn1 are turned on, the grayscale signals LG(m1n1), LR(m2n1) and LB(m2n1) from the driving unit 214 are written to the even pixel units connected to the gate line GLn1, respectively.

In phase 3 (the second time interval of the second time period), the first data control signal "Data SW1" causes the third switches 203 connected to the odd data lines (the data lines Dm1(R), Dm1(B) and Dm2(G) in FIG. 3) to turn on. Since the pixel thin-film transistors connected to the gate line GLn1 are turned on, the grayscale signals LR(m1n1), LB(m1n1) and LG(m2n1) from the driving unit 214 are written to the odd pixel units connected to the gate line GLn1, respectively.

In phase 4 (the third time period), the first gate control signal "Gate SW1" causes the first switches 201 to turn on. The reversal signal VGL output via the common terminal COM1 is transferred to the gate voltage storage capacitor Cn1. The gate voltage storage capacitor Cn1 is reversely charged and the voltage on the gate line GLn1 falls. At the end of phase 4, the voltage on the gate line GLn1 falls down to a minimum. The pixel thin-film transistors of the n1-th row of pixel units are turned off.

In phase 5 (a reset phase), all the external signals (including the scan signal and the grayscale signals) are at a low level. It is to be noted that this phase may also be omitted.

In phase 6 (the first time period), the second gate control signal "Gate SW2" causes the second switches 202 to turn on. The scan signal VGH output via the common terminal COM2 is transferred to the gate voltage storage capacitor Cn2. The gate voltage storage capacitor Cn2 is charged and the voltage on the gate line GLn2 rises. At the end of phase 6, the voltage on the gate line GLn2 reaches a peak.

In phase 7 (the first time interval of the second time period), the second data control signal "Data SW2" causes the fourth switches 204 connected to the even data lines (the data lines Dm1(G), Dm2(R) and Dm2(B) in FIG. 3) to turn on. Since the pixel thin-film transistors connected to the gate line GLn2 are turned on, the grayscale signals LG(m1n2), LR(m2n2) and LB(m2n2) from the driving unit 214 are written to the even pixel units connected to the gate line GLn2, respectively.

In phase 8 (the second time interval of the second time period), the first data control signal "Data SW1" causes the third switches 203 connected to the odd data lines (the data lines Dm1(R), Dm1(B) and Dm2(G) in FIG. 3) to turn on. Since the pixel thin-film transistors connected to the gate line GLn2 are turned on, the grayscale signals LR(m1n2), LB(m1n2) and LG(m2n2) from the driving unit 214 are written to the odd pixel units connected to the gate line GLn2, respectively.

In phase 9 (the third time period), the first gate control signal "Gate SW1" causes the first switches 201 to turn on. The reversal signal VGL output via the common terminal COM2 is transferred to the gate voltage storage capacitor Cn2. The gate voltage storage capacitor Cn2 is reversely charged and the voltage on the gate line GLn2 falls. At the end of phase 9, the voltage on the gate line GLn2 falls down to a minimum. The pixel thin-film transistors of the n2-th row of pixel units are turned off.

Thereafter the above operations are repeated for the respective rows of pixel units and thus are not described here.

In the above embodiment, the driving unit 214 may be implemented with an existing source driver chip. Alternatively, the driving unit 214 may be implemented with other hardware components, such as an application-specific integrated circuit (ASIC), a complex programmable logic device (CPLD) or a field programmable gate array (FPGA).

Figure 6:
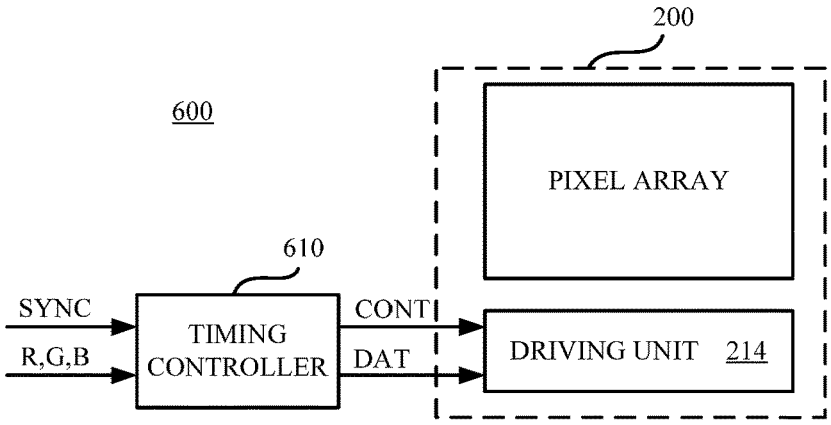
FIG. 6 is a block diagram of a display apparatus according to an embodiment of the present disclosure.

FIG. 6 is a block diagram of a display apparatus 600 according to an embodiment of the present disclosure.

Referring to FIG. 6, the display apparatus 600 includes a display panel 200 and a timing controller 610.

As described above, the display panel 200 includes an array of pixel units and a driving unit 214, the detailed description of which is omitted here.

The timing controller 610 receives a synchronization signal SYNC and input image data R, G, B from, for example, a system interface, and is configured to generate output image data DAT based on the input image data R, B. The output image data DAT is provided to the display panel 200 for display of images. The timing controller 610 further provides the driving unit 214 with a control signal CONT such as a clock signal. The driving unit 214 converts the output image data DAT to grayscale signals in response to the control signal CONT and supplies them to the pixel array.

In this embodiment, the timing controller 610 is further configured to generate a first data corresponding to the scan signal VGH and a second data corresponding to the reversal signal VGL. The driving unit 214 is further configured to generate the scan signal and the reversal signal based on the first data and the second data, respectively. For example, in the case that the display panel 200 has 256 grayscales, the first data to which the scan signal VGH corresponds may be +255, and the second data to which the reversal signal VGL corresponds may be −255. Furthermore, the digital data corresponding to a default gate line voltage signal may be 0.

It will be understood that the digital data corresponding to the first gate control signal "Gate SW1", the second gate control signal "Gate SW2", the first data control signal "Data SW1" and the second data control signal "Data SW2" as shown in FIGS. 4 and 5 may also be supplied by the timing controller 610 to the driving unit 214, which then generates corresponding voltage signals. Therefore, the voltage signals as shown in FIGS. 4 and 5 may be generated by the driving unit 214 based on the digital data received from the timing controller 610.

FIG. 7 is a digital data table for generation of the scan signal VGH, the reversal signal VGL and the grayscale signals as shown in FIG. 4.

Referring to FIG. 7, the signs "+" and "−" at the top of the table are indicative of the polarities of the signals. In the table, the numbers (255 and 0) represent the data for generation of the voltage signals in the first time period and the third time period, and R, B represent the pixel values for generation of the grayscale signals in the second time period.

The numbers in the table may be divided into groups, each of which includes four items, as the bold solid lines indicated. Each row of data in the table corresponds to the signals applied to a respective row of pixel units. Taking the first row as an example, the first items in respective groups correspond to the signals generated by the driving unit 214 and applied to the first row of pixel units via the common terminals COM1, COM2, COM3 in phase 1 of FIG. 4, the second items in respective groups correspond to the signals generated by the driving unit 214 and applied to the first row of pixel units via the common terminals COM1, COM2, COM3 in phase 2 of FIG. 4, the third items in respective groups correspond to the signals generated by the driving unit 214 and applied to the first row of pixel units via the common terminals COM1, COM2, COM3 in phase 3 of FIG. 4, and the fourth items in respective groups correspond to the signals generated by the driving unit 214 and applied to the first row of pixel units via the common terminals COM1, COM2, COM3 in phase 4 of FIG. 4.

FIG. 8 is a digital data table for generation of the scan signal VGH, the reversal signal VGL and the grayscale signals as shown in FIG. 5. With respect to those of FIG. 7, the polarities of the pixel values in FIG. 8 are inversed by columns.

Similar to FIG. 7, the numbers in the table may be divided into groups, each of which includes four items, as the bold solid lines indicated. Taking the first row as an example, the fourth items in respective groups correspond to the signals generated by the driving unit 214 and applied to the first row of pixel units via the common terminals COM1, COM2, COM3 in phase 1 of FIG. 5, the third items in respective groups correspond to the signals generated by the driving unit 214 and applied to the first row of pixel units via the common terminals COM1, COM2, COM3 in phase 2 of FIG. 5, the second items in respective groups correspond to the signals generated by the driving unit 214 and applied to the first row of pixel units via the common terminals COM1, COM2, COM3 in phase 3 of FIG. 5, and the first items in respective groups correspond to the signals generated by the driving unit 214 and applied to the first row of pixel units via the common terminals COM1, COM2, COM3 in phase 4 of FIG. 5.

According to another aspect of the present disclosure, a method of driving the display panel 200 as described in the above embodiments is provided.

The method includes, for each row of pixel units in the array, supplying the scan signal to the gate line connected to the row of pixel units in a first time period, and supplying respective grayscale signals to the plurality of data lines in a second time period immediately subsequent to the first time period.

In some embodiments, supplying the scan signal includes charging the gate voltage storage capacitor connected to the gate line with the scan signal, the charged gate voltage storage capacitor enabling the pixel thin-film transistors of the row of pixel units to remain turned-on during the second time period.

In some embodiments, supplying respective grayscale signals to the plurality of data lines includes supplying grayscale signals for odd pixel units in the row of pixel units to odd ones of the data lines in a first time interval, and supplying grayscale signals for even pixel units in the row of pixel units to even ones of the data lines in a second time interval.

In some embodiments, the method further includes supplying a reversal signal sequentially to the gate line connected to the row of pixel units in a third time period immediately subsequent to the second time period, the reversal signal having an opposite polarity to that of the scan signal.

In some embodiments, the method further includes generating, prior to supplying the scan signal, a first data corresponding to the scan signal and a second data corresponding to the reversal signal to enable the driving unit to generate the scan signal and the reversal signal based on the first data and the second data respectively.

Details of the driving method have been illustrated in the operations of the display panel 200 described above in connection with FIGS. 3-7, and thus are omitted here for simplicity.

According to the embodiments of the present disclosure, either a gate driver unit and a source driver unit that are separate from each other or a single driving circuit is arranged at an end of the data lines of the display panel, for example, at a bottom end of the display panel, thus saving the circuit footprint at the left and right sides of the display panel. This is advantageous to enable a narrow bezel or bezel-less design of the display panel.

It will be understood that the above embodiments are only exemplary embodiments for illustration of the principle of the present disclosure, and that the present disclosure is however not limited thereto. Various variations and improvements may be made by those skilled in the art without departing from the spirit and essence of the present disclosure. These variations and improvements are considered as falling within the scope of the present disclosure.

What is claimed is:

1. A display panel comprising:

a plurality of pixel units arranged in an array, each of the pixel units having a respective pixel thin-film transistor;

a plurality of gate lines extending in a first direction, each of the gate lines connected to a respective row of pixel units in the array;

a plurality of data lines extending in a second direction substantially perpendicular to the first direction, each of the data lines connected to a respective column of pixel units in the array;

a driving circuit arranged at an end of the data lines and comprising:

a plurality of common terminals for outputting a scan signal and respective grayscale signals;

a switch network operable to selectively couple the common terminals to the gate lines or the data lines; and a driving unit configured to a) supply the scan signal sequentially to the plurality of common terminals in a plurality of first time periods that are temporally separate and cause, in each first time period in which the scan signal is supplied to one of the common terminals, the switch network to couple the plurality of common terminals to the plurality of gate lines respectively such that the scan signal is applied to one of the gate lines, and to b) supply, in each of second time periods immediately subsequent to respective first time periods, the grayscale signals to the plurality of common terminals and cause the switch network to couple each of the common terminals to a respective one of the data lines such that the grayscale signals are transferred to the array of pixel units; and a plurality of gate voltage storage capacitors each connected between a respective one of the gate lines and a predetermined voltage and operable to enable, after being charged by the scan signal applied to the respective gate line, the pixel thin-film transistors of a row of pixel units connected to the gate line to remain turned-on in the second time period in which the grayscale signals for the row of pixel units are supplied.

2. The display panel of claim 1, wherein the driving unit is further configured to supply a reversal signal sequentially to the plurality of common terminals in a plurality of third time periods immediately subsequent to respective second time periods and cause, in each third time period in which the reversal signal is supplied to one of the common terminals, the switch network to couple the plurality of common terminals to the plurality of gate lines respectively to discharge the charged gate voltage storage capacitor, the reversal signal having an opposite polarity to that of the scan signal.

3. The display panel of claim 2, wherein the switch network comprises:

a plurality of first switches operable to couple the plurality of common terminals to the plurality of gate lines respectively in response to a first gate control signal supplied by the driving unit, the first gate control signal being synchronous with one of the scan signal and the reversal signal; and a plurality of second switches operable to couple the plurality of common terminals to the plurality of gate lines respectively in response to a second gate control signal supplied by the driving unit, the second gate control signal being synchronous with the other one of the scan signal and the reversal signal.

4. The display panel of claim 3, wherein the first switch and the second switch that are connected to the same gate line share the same common terminal.

5. The display panel of claim 3, wherein each of the first switches comprises a transistor having a gate for receiving the first gate control signal, a first electrode connected to a respective one of the common terminals, and a second electrode connected to a respective one of the gate lines.

6. The display panel of claim 3, wherein each of the second switches comprises a transistor having a gate for receiving the second gate control signal, a first electrode connected to a respective one of the common terminals, and a second electrode connected to a respective one of gate lines.

7. The display panel of claim 1, wherein the driving unit is further configured to in each of the second time periods:

supply, in a first time interval, grayscale signals for odd pixel units in a respective row of pixel units to the plurality of common terminals and cause the switch network to couple the plurality of common terminals to odd ones of the data lines respectively; and supply, in a second time interval, grayscale signals for even pixel units in the respective row of pixel units to the plurality of common terminals and cause the switch network to couple the plurality of common terminals to even ones of the data lines respectively.

8. The display panel of claim 7, wherein the switch network further comprises:

a plurality of third switches operable to couple the plurality of common terminals to the odd ones of the data lines in the first time interval in response to a first data control signal supplied by the driving unit; and a plurality of fourth switches operable to couple the plurality of common terminals to the even ones of the data lines in the second time interval in response to a second data control signal supplied by the driving unit.

9. The display panel of claim 8, wherein the driving unit is further configured such that the first data control signal and the second data control signal are successively supplied.

10. The display panel of claim 8, wherein each of the third switches is paired to a respective one of the fourth switches, wherein in each pair the third switch and the fourth switch share the same common terminal, and wherein the odd data line connected to the third switch is adjacent to the even data line connected to the fourth switch.

11. The display panel of claim 8, wherein each of the third switches comprises a transistor having a gate for receiving the first data control signal, a first electrode connected to a respective one of the common terminals, and a second electrode connected to a respective one of the odd data lines.

12. The display panel of claim 8, wherein each of the fourth switches comprises a transistor having a gate for receiving the second data control signal, a first electrode connected to a respective one of the common terminals, and a second electrode connected to a respective one of the even data lines.

13. A display apparatus comprising:

a timing controller configured to generate output image data based on input image data; and the display panel as recited in claim 1, the display panel configured to display an image based on the output image data.

14. The display apparatus of claim 13, wherein the driving unit is further configured to supply a reversal signal sequentially to the plurality of common terminals in a plurality of third time periods immediately subsequent to respective second time periods and cause, in each third time period in which the reversal signal is supplied to one of the common terminals, the switch network to couple the plurality of common terminals to the plurality of gate lines respectively to discharge the charged gate voltage storage capacitor, the reversal signal having an opposite polarity to that of the scan signal;

wherein the timing controller is further configured to generate a first data corresponding to the scan signal and a second data corresponding to the reversal signal; and wherein the driving unit is further configured to generate the scan signal, the reversal signal and the grayscale signals based on the first data, the second data and the output image data respectively.

15. A method of driving the display panel as recited in claim 1, comprising:

for each row of pixel units in the array:

supplying the scan signal to the gate line connected to the row of pixel units in a first time period; and supplying respective grayscale signals to the plurality of data lines in a second time period immediately subsequent to the first time period.

16. The method of claim 15, wherein supplying the scan signal to the gate line connected to the row of pixel units comprises charging the gate voltage storage capacitor connected to the gate line with the scan signal, the charged gate voltage storage capacitor enabling the pixel thin-film transistors of the row of pixel units to remain turned-on during the second time period.

17. The method of claim 16, wherein supplying respective grayscale signals to the plurality of data lines comprises:

supplying grayscale signals for odd pixel units in the row of pixel units to odd ones of the data lines in a first time interval; and supplying grayscale signals for even pixel units in the row of pixel units to even ones of the data lines in a second time interval.

18. The method of claim 15, further comprising supplying a reversal signal sequentially to the gate line connected to the row of pixel units in a third time period immediately subsequent to the second time period, the reversal signal having an opposite polarity to that of the scan signal.

19. The method of claim 18, further comprising generating, prior to supplying the scan signal, a first data corresponding to the scan signal and a second data corresponding to the reversal signal to enable the driving unit to generate the scan signal and the reversal signal based on the first data and the second data respectively.

* * * * *